US010791817B1

(12) United States Patent
Ismail

(10) Patent No.: US 10,791,817 B1
(45) Date of Patent: Oct. 6, 2020

(54) PROTECTIVE DISPOSABLE BIB

(71) Applicant: Laura Ismail, Aptos, CA (US)

(72) Inventor: Laura Ismail, Aptos, CA (US)

( * ) Notice: Subject to any disclaimer, the term of this patent is extended or adjusted under 35 U.S.C. 154(b) by 0 days.

(21) Appl. No.: 16/298,472

(22) Filed: Mar. 11, 2019

(51) Int. Cl.
*A45D 44/08* (2006.01)

(52) U.S. Cl.
CPC ..... *A45D 44/08* (2013.01)

(58) Field of Classification Search
CPC ..... A45D 44/16; A45D 44/08; A41B 13/10; A41B 2400/52
USPC ..... 2/50
See application file for complete search history.

(56) References Cited

U.S. PATENT DOCUMENTS 2,357,461 A * 9/1944 Ellinger ..... A45D 44/08 4/521
4,793,004 A * 12/1988 Long ..... A41B 13/103 2/49.3
5,079,777 A * 1/1992 Fowler ..... A45D 44/08 2/46
5,963,986 A * 10/1999 Deppen ..... A41B 13/10 2/49.1
7,237,271 B1 * 7/2007 McLandrich ..... A41B 13/106 2/49.1
2002/0069446 A1 * 6/2002 Pinckney ..... A41B 13/10 2/49.1

* cited by examiner

*Primary Examiner* — Tajash D Patel
(74) *Attorney, Agent, or Firm* — Donald R. Boys; Central Coast Patent Agency LLC

(57) ABSTRACT

A bib for protecting a subject in washing the subject's hair is a contiguous panel of biodegradable plastic having a thickness of from 0.3 mm. to 1 mm., a width of from 12 to 16 inches, and an overall length of from 15 to 20 inches. A cutout from one end of the length of the panel is centered on the width, the cutout extending from 8 to 12 inches from the one end, having a curved end away from the one end, leaving two extended regions each having a width of from 1 inch to 2 inches.

3 Claims, 1 Drawing Sheet

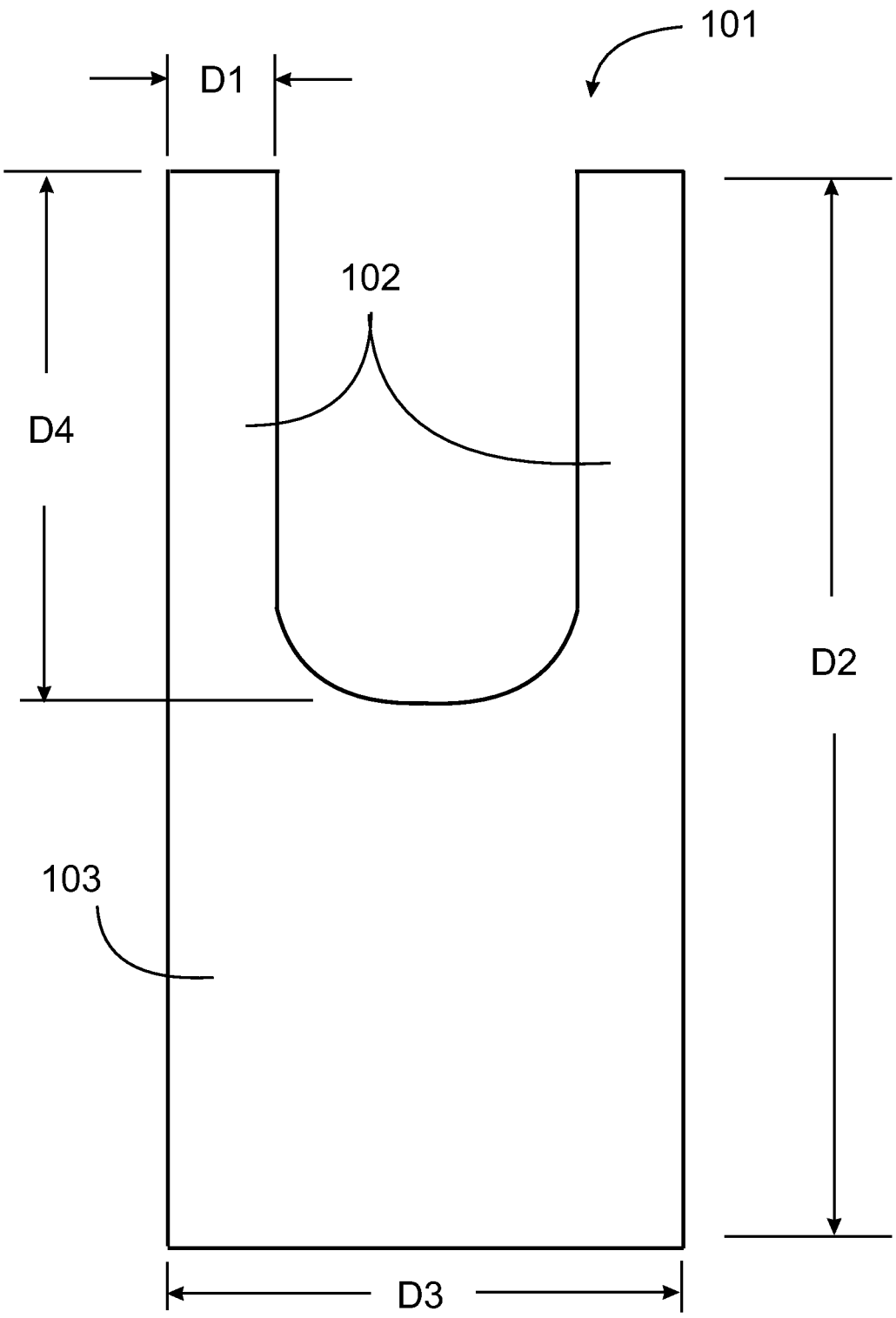
101
D1
102
D4
D2
103
D3

PROTECTIVE DISPOSABLE BIB

BACKGROUND OF THE INVENTION

1. Field of the Invention

The present invention is in the technical area of protective coverings for use in hair styling and processing.

2. Description of Related Art

Protective articles for use in many circumstances are well-know. A particular problem not addressed before the filing of this application, however, is in protecting a subject's person and clothing when washing the subject's hair by the subject reclining and placing the head over a shampoo bowl. Many subjects are physically built in a way that the head and neck in relation to the shampoo bowl do not provide for a barrier to water leaking from the bowl to the subject's clothing.

What is needed is a simple bib that may be placed on a subject's back at and below the neck area, that can also be tied around the subject's neck to hold the bib in place.

BRIEF SUMMARY OF THE INVENTION

In one embodiment of the invention a bib for protecting a subject in washing the subject's hair is provided, comprising a contiguous panel of biodegradable plastic having a thickness of from 0.3 mm. to 1 mm., a width of from 12 to 16 inches, and an overall length of from 15 to 20 inches, and a cutout from one end of the length of the panel, centered on the width, the cutout extending from 8 to 12 inches from the one end, having a curved end away from the one end, leaving two extended regions each having a width of from 1 inch to 2 inches. In one embodiment the material is other than biodegradable.

BRIEF DESCRIPTION OF THE SEVERAL VIEWS OF THE DRAWINGS

FIG. 1 is a front view of a disposable, protective bib according to an embodiment of the present invention

DETAILED DESCRIPTION OF THE INVENTION

FIG. 1 is a front view of a disposable, protective bib 101 according to an embodiment of the present invention. Bib 101 is made from a single-ply biodegradable plastic in a preferred embodiment of the invention, with a thickness from 0.3 mm to about 1 mm. In alternative embodiment the material may be plastic that is not biodegradable, such as polyethylene.

The bib has a contiguous body of a width D3 and an overall length of D2. At one end of the width the bib is cut out leaving two extensions 102 of width D1, with a length D4. The cut-out has a curved end with a radius of about 5 inches. The radius in different embodiments may vary widely.

In preferred embodiments of the invention D3 may be from a minimum of about 12 inches to a maximum of about 16 inches. The overall length D2 may be from about 15 to about 20 inches. Width D1 may be from about 1 inch to as much as 2 inches. The depth D4 may be from about 8 inches to about 12 inches.

In use the bib is placed on the back of a subject with the curved portion of the cut out at the back of the subject's neck, and the ties 102 are drawn around to the front and tied in the front of the user's neck. The subject then reclines on the back and places the neck in the receptacle of a hair-washing bowl.

A person of skill in the art will understand that the descriptions above are exemplary, and in some cases preferable, but there may be a variety of changes that might be made within the scope of the invention. The invention is limited only by the claims that follow.

I claim:

1. A method for protecting a user's clothing from water in a process of washing and rinsing hair, comprising:

preparing a rectangular plastic film having a width of at least twelve inches and an overall length of at least 15 inches, the plastic film having a cutout from one end of the length, centered on the width, the cutout extending a maximum of 12 inches from the one end, having a semi-circular curved end away from the one end, leaving two extended tie regions each having a width of at least one inch, and an extended panel below the cutout with a length of at least three inches;

placing the extended panel over the user's back with the semicircular curved end at the back of the user's neck, drawing the tie regions around the neck and tying in front;

reclining the user on the back with the head over a shampoo bowl, and the neck in a receptacle of the shampoo bowl; and washing and rinsing the hair, the clothing protected from water in the process by the plastic film tied around the neck and extending over the receptacle in the rim of the shampoo bowl.

2. The method of claim 1 wherein, in the preparation step the plastic film has a thickness of from 0.3 mm. to 1 mm.

3. The method of claim 1 wherein, in the preparing step, the bib is fashioned of a biodegradable film.

* * * * *